US010065290B2

(12) United States Patent
Xue et al.

(10) Patent No.: US 10,065,290 B2
(45) Date of Patent: Sep. 4, 2018

(54) COMBINED TYPE WHEEL BURR BRUSH

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC Discastal CO., LTD, Qinhuangdao (CN)

( * ) Notice: Subject to any disclaimer, the term of this patent is extended or adjusted under 35 U.S.C. 154(b) by 83 days.

(21) Appl. No.: 15/392,623

(22) Filed: Dec. 28, 2016

(65) Prior Publication Data

US 2017/0182634 A1 Jun. 29, 2017

(30) Foreign Application Priority Data

Dec. 29, 2015 (CN) ..... 2015 1 1006475

(51) Int. Cl.
*B24D 13/10* (2006.01)
*B24D 13/14* (2006.01)
*B24B 9/04* (2006.01)

(52) U.S. Cl.
CPC ..... *B24D 13/145* (2013.01); *B24B 9/04* (2013.01); *B24D 13/10* (2013.01)

(58) Field of Classification Search
CPC ..... B24D 13/145; B24D 13/10; B24B 9/04; A46B 7/04; A46B 2200/3046;
(Continued)

(56) References Cited

U.S. PATENT DOCUMENTS 1,538,220 A * 5/1925 Shultz ..... A46B 9/10 15/169
1,584,997 A * 5/1926 Shultz ..... A46B 9/10 15/197

(Continued)

FOREIGN PATENT DOCUMENTS

FR 3000913 A3 * 7/2014 ..... B24D 7/066

*Primary Examiner* — George Nguyen
(74) *Attorney, Agent, or Firm* — Howard IP Law Office; Jeremy Howard

(57) ABSTRACT

The invention relates to a combined type wheel burr brush, consisting of a lower bottom plate, lantern rings, nylon brush units, an upper bottom plate, steel-wire brush units and the like, wherein the steel-wire brush units in II and IV areas are floating, and under a natural state, the height of the steel-wire brush units is 10 mm higher than that of the nylon brush units; when in work, the steel-wire brush units firstly contact a spoke of a back cavity of a wheel, burrs of the back cavity of the wheel can be removed powerfully when the steel-wire brush units rotate, the steel-wire brush units are continuously compressed, and when the nylon brush units also contact the spoke of the back cavity, burrs at corners can be smoothened; and when a small-size wheel is encountered, by removing the lower bottom plate, the fast locks and the lantern rings, a small-size burr brush can be formed. When the burr brush combining the steel-wire brush units with the nylon brush units of the invention is in use, not only can the efficiency of removing the burrs of the back cavity of the wheel be improved, but also the removing effect is very obvious, and meanwhile, the service life of the brush can be greatly prolonged.

3 Claims, 2 Drawing Sheets

(58) Field of Classification Search
CPC ..... Y10T 403/7005; Y10T 403/7015; Y10T 403/7016
USPC ..... 451/485, 486, 519, 514, 521, 359, 353; 403/348, 353, 354; 15/53.4
See application file for complete search history.

(56) References Cited

U.S. PATENT DOCUMENTS 2,332,936 A * 10/1943 Schlegel ..... A46B 13/008 15/230
4,037,369 A * 7/1977 Campbell ..... A46B 9/06 15/180
4,446,880 A * 5/1984 Gueret ..... A45D 40/265 132/218
5,011,230 A * 4/1991 Weihrauch ..... A46B 3/06 300/21
5,148,568 A * 9/1992 Bojar ..... A46B 7/08 15/28
5,221,123 A * 6/1993 Klinkhammer ..... A46B 3/00 264/243
5,249,760 A * 10/1993 Morimoto ..... A01K 89/01 242/279
5,412,829 A * 5/1995 Hefner ..... A46B 7/02 15/160
5,707,278 A * 1/1998 Korn ..... B24B 33/08 300/21
6,126,533 A * 10/2000 Johnson ..... A46B 3/005 451/359
6,244,947 B1 * 6/2001 Van Osenbruggen ... A46B 9/06 15/141.2
6,312,323 B1 * 11/2001 Warner ..... B24D 13/02 451/450
8,579,677 B2 * 11/2013 Boudreau ..... B24D 3/28 451/28
8,702,335 B2 * 4/2014 Young ..... F24J 2/5205 403/22
8,764,517 B2 * 7/2014 Telischak, Jr. ..... B24B 23/02 451/359
9,357,831 B2 * 6/2016 Jensen ..... B29C 45/14385
9,682,456 B1 * 6/2017 McGeary ..... B24B 9/007
2001/0012753 A1 * 8/2001 Cox ..... A46B 13/001 451/464
2003/0181154 A1 * 9/2003 Fischer ..... A61C 3/06 451/532
2008/0160886 A1 * 7/2008 Palushaj ..... A46B 13/008 451/353
2010/0051261 A1 * 3/2010 Koleilat ..... E21B 17/07 166/177.5
2012/0023692 A1 * 2/2012 Boucherie ..... A46B 3/06 15/207.2

* cited by examiner

COMBINED TYPE WHEEL BURR BRUSH

This application claims priority from CN 201511006475.2, filed on Dec. 29, 2015, the entire content of which is incorporated herein by reference.

TECHNICAL FIELD

The invention relates to a burr brush, in particular to a combined type wheel burr brush with changeable size.

BACKGROUND ART

During a production process of an aluminum alloy wheel, very sharp burrs will be formed after machining; a current processing method is to place the wheel on a special device and remove the burrs by using a special brush, but the removing efficiency is very low, the removing effect is not obvious, and meanwhile brush hairs are consumables, so that the brush needs to be replaced frequently, resulting in high burr brushing cost. The combined type brush of the invention can completely avoid abovementioned problems, can improve burr brushing efficiency and effect, and meanwhile can reduce the unit burr brushing cost.

SUMMARY OF THE INVENTION

An object of the invention is to provide a combined type wheel burr brush with changeable size.

To achieve the object described above, a technical solution of the present invention is as follows: a combined type wheel burr brush is composed of a lower bottom plate, nuts, locating pins, fast locks, lantern rings, nylon brush units, an upper bottom plate, springs and steel-wire brush units. The lower bottom plate, the lantern rings and the upper bottom plate are uniformly divided into four areas; the nylon brush units are fixed in I and III areas of the upper bottom plate and the lantern rings by the nuts; the steel-wire brush units are fixed in II and IV areas of the upper bottom plate and the lantern rings by the nuts; the outside of a fixed link at a lower end of each steel-wire brush unit is sleeved with the spring placed under the steel-wire brush unit; the plurality of locating pins are fixed under the lantern rings, and matched with holes in the lower bottom plate; and not less than three fast locks are fixed on the lower bottom plate, and matched with pull rings fixed on the lantern rings.

By removing the lower bottom plate, the fast locks and the lantern rings, a small-size burr brush can be formed.

The steel-wire brush units in the II and IV areas are floating, and under a natural state, the height of the steel-wire brush units is 10 mm higher than that of the nylon brush units.

When in actual use, the steel-wire brush units in the II and IV areas are floating, the steel-wire brush units firstly contact a spoke of a back cavity of a wheel, burrs of the back cavity of the wheel can be removed powerfully when the steel-wire brush units rotate, the steel-wire brush units are continuously compressed, and when the nylon brush units also contact the spoke of the back cavity, burrs at corners can be smoothened; and when a small-size wheel is encountered, by removing the lower bottom plate, the fast locks and the lantern rings, a small-size burr brush can be formed.

When the burr brush combining the steel-wire brush units with the nylon brush units of the invention is in use, not only can the efficiency of removing the burrs of the back cavity of the wheel be improved, but also the removing effect is very obvious, and meanwhile, the service life of the brush can be greatly prolonged.

Figure 1:
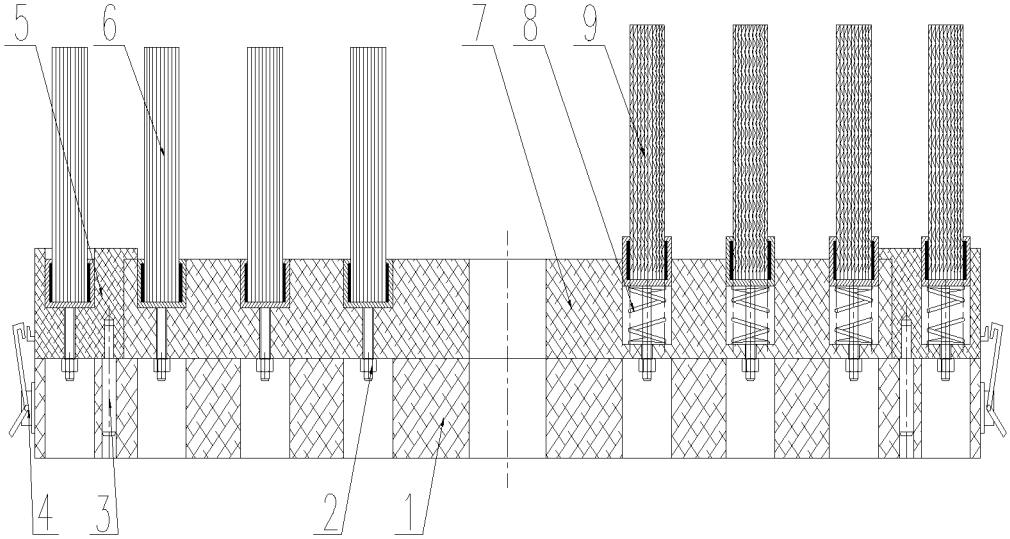
FIG. 1 is a front view of a combined type wheel burr brush provided by the present invention.
Figure 2:
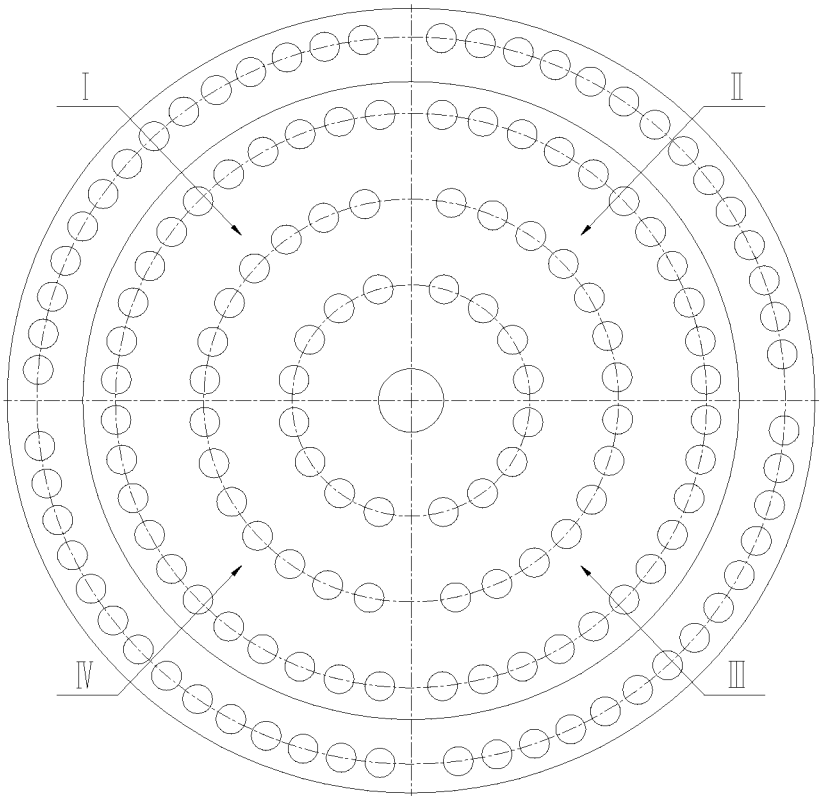
FIG. 2 is a top view of a combined type wheel burr brush provided by the present invention.
Figure 3:
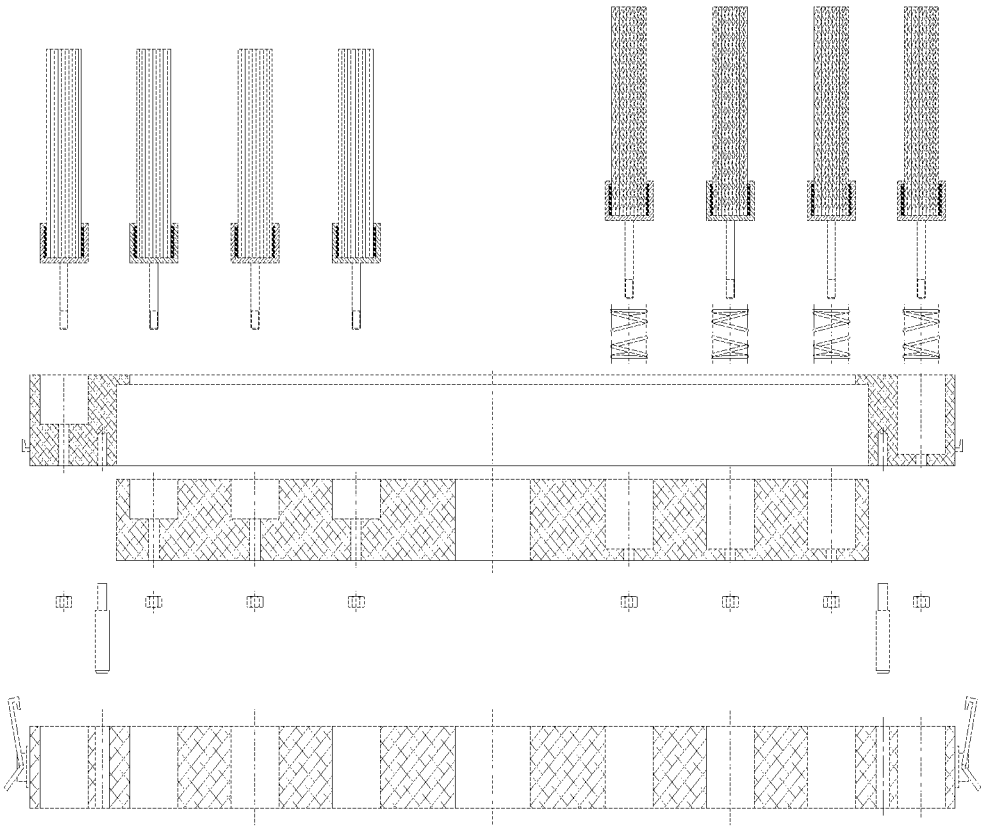
FIG. 3 is an exploded front view of a combined type wheel burr brush provided by the present invention.

In the figures, 1—lower bottom plate, 2—nut, 3—locating pin, 4—fast lock, 5—lantern ring, 6—nylon brush unit, 7—upper bottom plate, 8—spring, and 9—steel-wire brush unit.

DETAILED DESCRIPTION OF THE INVENTION

In the following, the details and working conditions of a specific device provided by the present invention are described in combination with the figures.

A burr brush is composed of a lower bottom plate 1, nuts 2, locating pins 3, fast locks 4, lantern rings 5, nylon brush units 6, an upper bottom plate 7, springs 8 and steel-wire brush units 9. The lower bottom plate 1, the lantern rings 5 and the upper bottom plate 7 are uniformly divided into four areas; the nylon brush units 6 are fixed in I and III areas of the upper bottom plate 7 and the lantern rings 5 by the nuts 2; the steel-wire brush units 9 are fixed in II and IV areas of the upper bottom plate 7 and the lantern rings 5 by the nuts 2; the outside of a fixed link at a lower end of each steel-wire brush unit 9 is sleeved with the spring 8 placed under the steel-wire brush unit 9; the plurality of locating pins 3 are fixed under the lantern rings 5, and matched with holes in the lower bottom plate 1; and not less than three fast locks 4 are fixed on the lower bottom plate 1, and matched with pull rings fixed on the lantern rings 5.

By removing the lower bottom plate 1, the fast locks 4 and the lantern rings 5, a small-size burr brush can be formed.

The steel-wire brush units 9 in the II and IV areas are floating, and when not in work, the height of the steel-wire brush units 9 is 10 mm higher than that of the nylon brush units 6.

During a working process, the steel-wire brush units 9 in the II and IV areas are floating, the steel-wire brush units 9 firstly contact a spoke of a back cavity of a wheel, burrs of the back cavity of the wheel can be removed powerfully when the steel-wire brush units 9 rotate, the steel-wire brush units 9 are continuously compressed, and when the nylon brush units 6 also contact the spoke of the back cavity, burrs at corners can be smoothened; and when a small-size wheel is encountered, by removing the lower bottom plate 1, the fast locks 4 and the lantern rings 5, a small-size burr brush can be formed.

What is claimed is:

1. A combined type wheel burr brush, comprising: a lower bottom plate (1), nuts (2), locating pins (3), fast locks (4), lantern rings (5), nylon brush units (6), an upper bottom plate (7), springs (8) and steel-wire brush units (9); characterized in that the lower bottom plate (1), the lantern rings (5) and the upper bottom plate (7) are uniformly divided into four areas; the nylon brush units (6) are fixed in I and III areas of the upper bottom plate (7) and the lantern rings (5) by the nuts (2); the steel-wire brush units (9) are fixed in II and IV areas of the upper bottom plate (7) and the lantern rings (5) by the nuts (2); the outside of a fixed link at a lower end of each steel-wire brush unit (9) is sleeved with the spring (8) placed under the steel-wire brush unit (9); the plurality of locating pins (3) are fixed under the lantern rings (5), and matched with holes in the lower bottom plate (1); and not less than three fast locks (4) are fixed on the lower bottom plate (1), and matched with pull rings fixed on the lantern rings (5).

2. The combined type wheel burr brush according to claim 1, characterized in that: by removing the lower bottom plate (1), the fast locks (4) and the lantern rings (5), a small-size burr brush can be formed.

3. The combined type wheel burr brush according to claim 1, characterized in that: the steel-wire brush units (9) in the II and IV areas are floating, and when not in work, the height of the steel-wire brush units (9) is 10 mm higher than that of the nylon brush units (6).

* * * * *